US008387816B2

(12) United States Patent
Fallas

(10) Patent No.: US 8,387,816 B2
(45) Date of Patent: Mar. 5, 2013

(54) DUAL USE BEVERAGE CUP

(75) Inventor: Solomon Fallas, Brooklyn, NY (US)

(73) Assignee: Solomon Fallas, New York, NY (US)

( * ) Notice: Subject to any disclaimer, the term of this patent is extended or adjusted under 35 U.S.C. 154(b) by 0 days.

(21) Appl. No.: 13/040,136

(22) Filed: Mar. 3, 2011

(65) Prior Publication Data

US 2012/0223082 A1 Sep. 6, 2012

(51) Int. Cl.
*A47G 19/22* (2006.01)

(52) U.S. Cl. ..... 220/503; 220/703

(58) Field of Classification Search ..... 220/505, 220/506, 503, 501, 703
See application file for complete search history.

(56) References Cited

U.S. PATENT DOCUMENTS

| | | | | |
|---|---|---|---|---|
| 2,374,092 | A | 8/1942 | Glaser | |
| D167,667 | S | 11/1949 | Babany | |
| 3,021,977 | A | 2/1962 | Hester | |
| 3,434,626 | A * | 3/1969 | Kinslow, Jr. | 220/608 |
| 3,471,055 | A * | 10/1969 | Edwards | 206/520 |
| 3,729,114 | A * | 4/1973 | Mari | 220/504 |
| 3,730,385 | A * | 5/1973 | Rost | 206/520 |
| 3,973,693 | A * | 8/1976 | Brocklehurst | 220/604 |
| 4,832,212 | A * | 5/1989 | Askinazi | 215/10 |
| 5,419,436 | A | 5/1995 | Powell | |
| D363,854 | S | 11/1995 | Katz | |
| 5,487,486 | A | 1/1996 | Meneo | |
| 5,772,065 | A * | 6/1998 | Kalamaras | 220/612 |
| D407,864 | S | 4/1999 | Olaiz | |
| D418,015 | S | 12/1999 | Santini | |
| 6,409,374 | B1 * | 6/2002 | Willat | 366/130 |
| 6,644,846 | B2 * | 11/2003 | Willat | 366/130 |
| D561,534 | S | 2/2008 | Marks | |
| D580,228 | S * | 11/2008 | Hayden | D7/513 |
| D630,060 | S * | 1/2011 | DelVecchio | D7/534 |
| 2007/0267424 | A1 * | 11/2007 | Marks | 220/703 |

* cited by examiner

*Primary Examiner* — Steven A. Reynolds
*Assistant Examiner* — King M Chu
(74) *Attorney, Agent, or Firm* — Davidson, Davidson & Kappel, LLC

(57) ABSTRACT

A stackable beverage cups and, in particular to a dual use stackable beverage cup that can be used both as a standard size cup and as a smaller shot size cup.

15 Claims, 8 Drawing Sheets

DUAL USE BEVERAGE CUP

FIELD OF THE INVENTION

This invention relates to stackable beverage cups and, in particular to a dual use stackable beverage cup that can be used both as a standard size cup and as a smaller shot size cup.

BACKGROUND OF THE INVENTION

Glassware and plastic cups can take up considerable closet or shelf space and purchasing separate cups for different amounts of fluid use is both inconvenient and expensive. Plastic cups are often used for gatherings where it would be inconvenient to wash dishes afterward, due to factors such as location or number of guests and having plastic cups in multiple size cups is also both inconvenient and expensive. Space is often an issue for plastic cups, as well. Attempts to overcome these problems have been attempted with dual usage beverage containers. For example, US D580228 S depicts an ornamental design for a reversible beverage cup. The exterior of the design is cone shaped and two beverage cups contained within the cone are diametrically opposed with a barrier between the bases of each cup, such that when one side of the cup is in use, the other side serves as a base. The design is bulky as the cups do not occupy all of the space within the cone shape.

Another example of a dual use cup is seen in U.S. D418015 which is an ornamental design for a double goblet. In this design, the two separate beverage containers are also diametrically opposed and the opening of one serves as the base of the other. The containers are connected at the base of each goblet by a connecting stem.

Yet another example of a dual beverage container cup is seen in U.S. 2007/0267424 which comprises two cups, wherein the opening for each cup serves as the base for the other. In the '424 application, one cup is smaller than the other and the opening for the smaller cup is the edge of the base for the larger cup.

While advancements in the beverage technology have been made, the prior art dual container cups are not without fault and, even when stacked, can take up considerable space.

Thus, there still exists a need to provide a dual container cup that is efficient to use and store, that can be made cheaply and that can be stacked easily and in as small a space as possible.

SUMMARY OF THE INVENTION

The present invention is directed to a reversible, two-in-one, multi-use beverage cup, that can be used either as a standard sized cup or a smaller "shot-sized" cup and that can be stacked.

It is an object of the present invention to provide a reversible, two-in-one, multi-use beverage cup, that can be used both as a standard sized cup and a smaller sized cup, wherein the smaller cup is contained within the larger cup and the open edge of the smaller cup contacts a portion of the larger cup and wherein the beverage cup is stackable. In certain embodiments, the larger cup can hold 16 ounces of liquid and the smaller cup can hold 2 ounces of liquid.

It is another object of the present invention to provide a disposable cup made of an appropriate material for beverages. In certain embodiments, the disposable cups are made of one or more plastics, such as polypropylene (PP); polyethylene terephthalate (PETE or PET); high density polyethylene (HDPE); low density polyethylene (LDPE); polystyrene (PS); acrylic polycarbonate; polyactic acid; and polyvinyl chloride.

It is another object of the present invention to provide a stackable dual beverage cup having one side for use as a smaller "shot-sized" cup to hold smaller amounts of a beverage in an amount of, for example, 1, 1.5, 2 or 2.5 ounces, and another side for use as a larger cup for holding larger amounts of beverage, in an amount of, for example, 8, 12, 16 or 18 ounces. In certain preferred embodiments the stackable, dual sized beverage cup has an 8 ounce sized larger cup and a 1 ounce sized smaller cup, a 16 ounce sized larger cup and a 1.5 ounce sized smaller cup, a 16 ounce larger cup and a 2 ounce sized smaller cup or an 18 ounce sized larger cup and a 2.5 ounce sized smaller cup.

DETAILED DESCRIPTION

Before explaining the present invention in detail, it is to be understood that the invention is not limited to the particular embodiments and that it can be practiced or carried out in various ways.

An improved dual use beverage cup is provided having one side for use with a larger, standard size amount of fluid (e.g. 8, 10, 12, 14, 16 or 18 ounces) and the other side for use with a smaller standard amount of fluid (e.g. 1, 1.5, 2 or 2.5 ounces), commonly known as a "shot" size. The smaller cup is located within the bigger cup, with the opening of the smaller cup located at the base of the larger cup and a portion of the edge of smaller cup contacting a portion of the edge of the base of the larger cup. In certain embodiments, approximately 3/38 of 1 inch of the outer edge of the opening of the smaller cup connects with the outer edge of the base of the larger cup.

In certain embodiments of the present invention, the surface area of the top of the smaller cup occupies from about 3/5 to about 7/10 of the surface area of the base of the larger cup. In certain embodiments, the base of the smaller shot cup is slightly offset from the center of the larger cup.

Although the cups of the present invention are depicted with circular openings and bases, it is also possible for the cups to have other suitable shapes, for example, oval, square or rectangular. It is also possible for the larger cup to have a different shape than the smaller cup. For example, the larger cup may have a circular opening and base whereas the smaller cup may have an oval opening and base.

In a preferred embodiment, the beverage cup comprises a larger sized cup that can hold e.g. approximately 16 ounces of fluid and a smaller "shot" sized cup which can hold approximately 2 ounces of fluid. In certain other preferred embodiments, the stackable dual beverage cup has an 8 ounce sized larger cup and a 1 ounce sized smaller cup, a 16 ounce sized larger cup and a 1.5 ounce sized smaller cup or an 18 ounce sized larger cup and a 2.5 ounce sized smaller cup.

Figure 1:
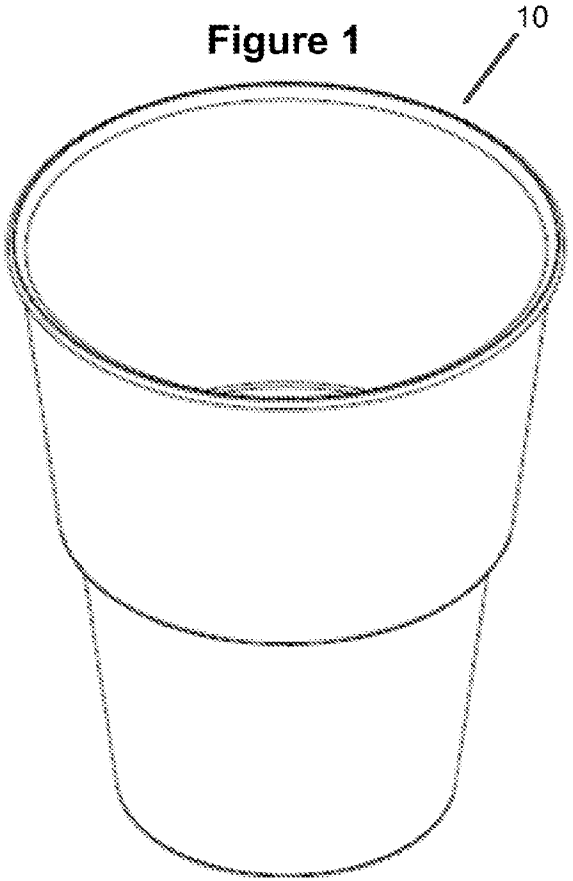
FIG. 1 is an exterior view of the beverage cup, of the present invention.

FIG. 1 is an external view of the dual use, stackable beverage cup 10 which shows the external view of the cup, with the interior smaller cup not visible, so that the beverage cup appears like a typical single use cup.

Figure 2:
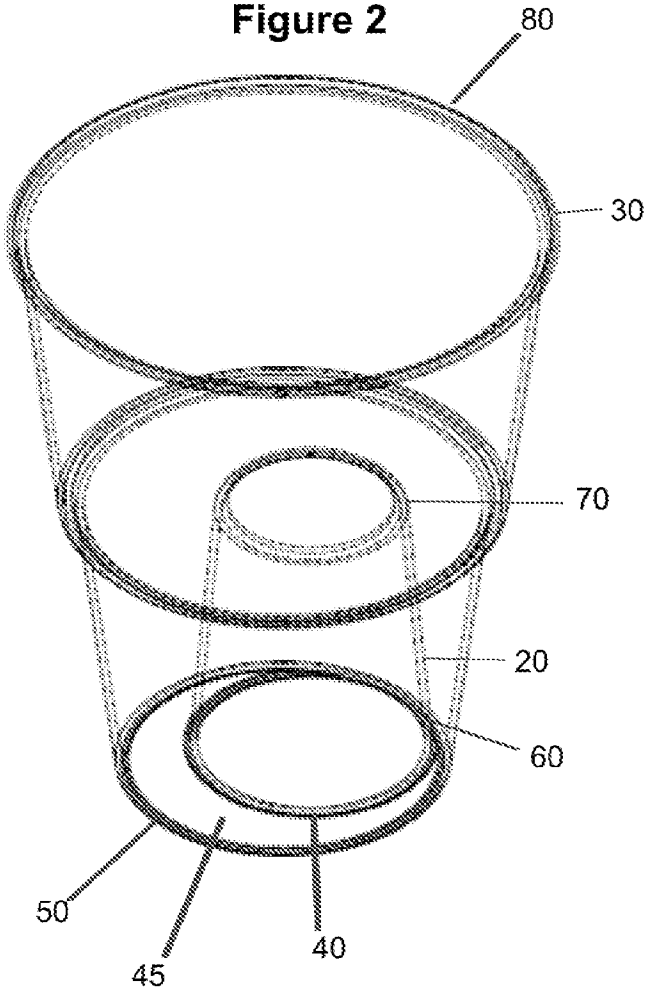
FIG. 2 is an exterior transparent view of the beverage cup, showing the placement of the larger cup and smaller "shot" cup.

FIG. 2 shows an exterior transparent view of the beverage cup 10, showing the duel cup placement, with smaller cup 20 being contained within the larger cup 30 in an inverted position. The opening 40 of the smaller cup 20 contacts the base 50 of the larger cup 30 at edge 60. The base of the large cup consists of the opening 40 of the smaller cup and a semicircular crescent-shaped portion 45 which contacts a substantial portion of the opening of the small cup. As seen in both FIG. 2 and FIG. 3, the base 70 of the smaller cup may be offset from the center of the larger cup 80 in certain embodiments.

Figure 3:
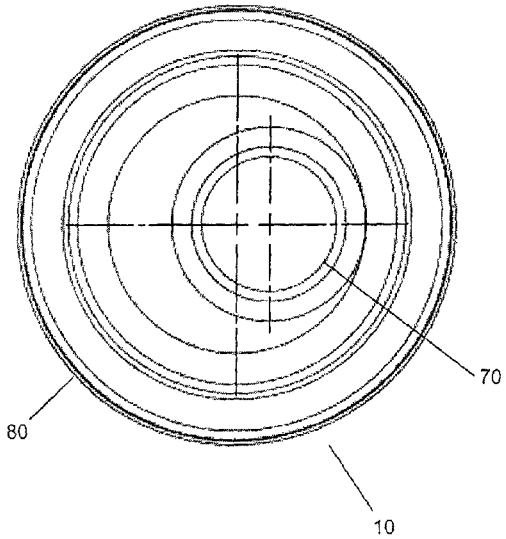
FIG. 3 is a top view of the cup, showing where the base of the smaller cup is situated.

FIG. 3 shows a top view of the beverage cup. The base 70 of the smaller cup 20 is located off-center, though in certain embodiments, it is possible for it to be situated in the middle of the larger cup.

Figure 4:
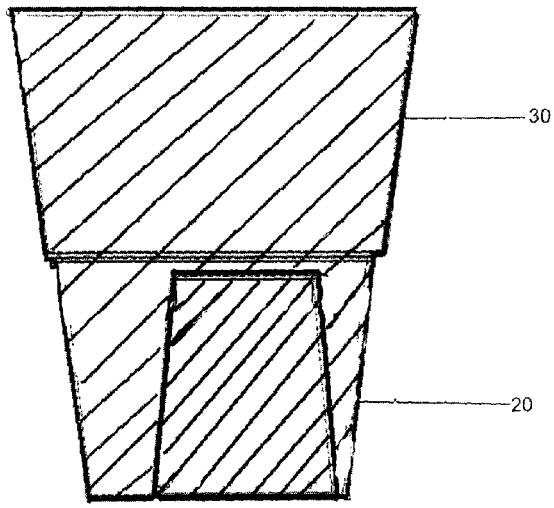
FIG. 4 is a sectional view of the smaller cup, showing the general volume of the larger cup and the general volume of the smaller cup.

The relative volumes of the larger and smaller cup are depicted in FIG. 4. As explained above, in certain embodiments of the present invention, the amount of liquid that can be held by the larger cup can vary from 8 to 18 ounces whereas the amount of liquid that can be held by the smaller cup can vary from 1 to 2.5 ounces.

Figure 5:
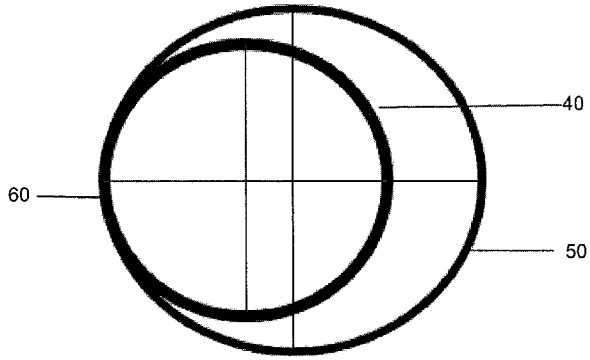
FIG. 5 is a bottom view of the present invention.

FIG. 5 shows a view from the bottom of the cup, with a view of the opening 40 of the smaller cup 20 and the base 50 of the larger cup 30. The outer edge of the opening of the smaller cup connects at 60 with the outer edge of the base of the larger cup.

Figure 6:
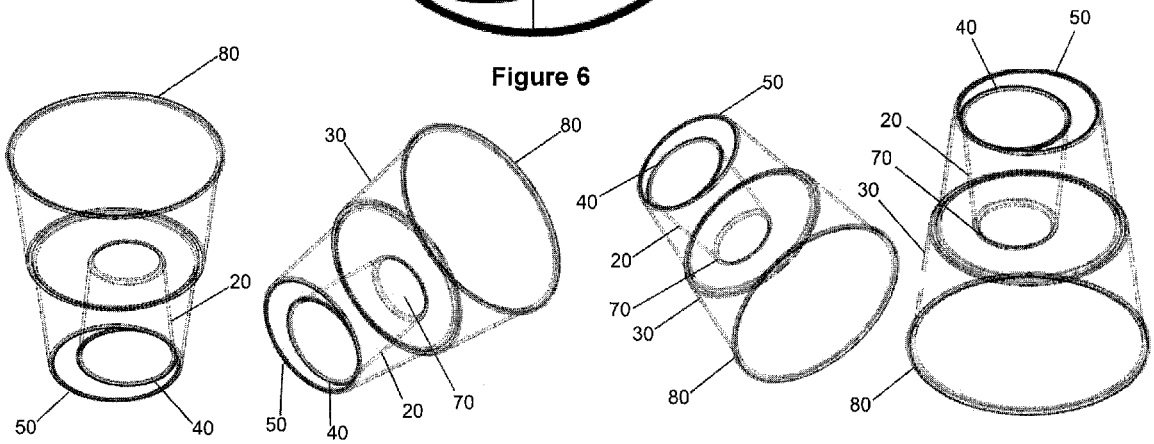
FIG. 6 (*a*) through (*d*) show multi angle views of the beverage cup, showing the cup as it is rotated 180 degrees to utilize either the larger cup or smaller cup.

As shown in FIG. 6, the dual nature of the beverage cup 10 of the present invention is achieved by rotating the cup 180 degrees. When the opening, or top, 40 of the smaller cup 20 is facing down, the larger cup which holds more liquid can be used. When the opening, or top, 40 of the smaller shot sized cup 20 is facing up, the smaller cup which holds less liquid can be used.

Figure 7:
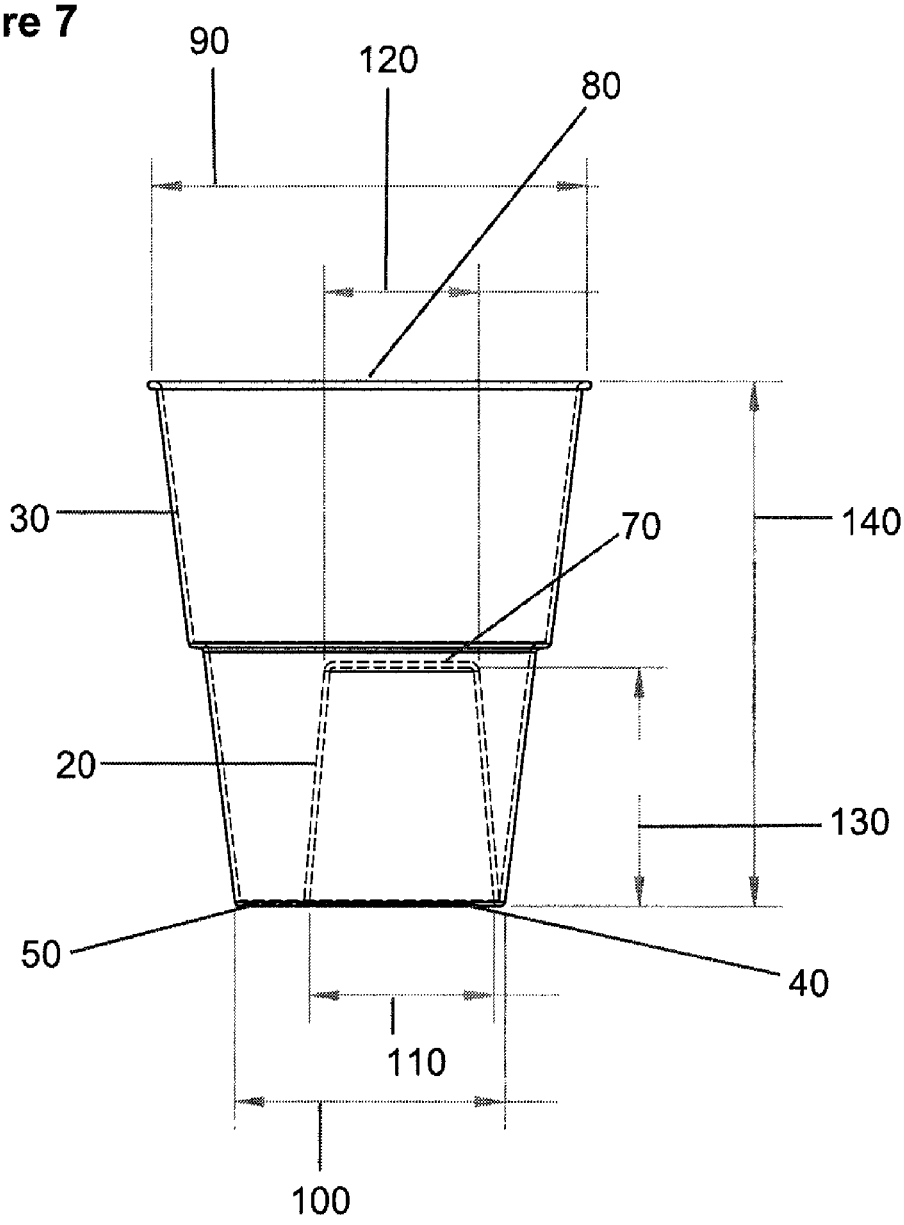
FIG. 7 shows possible dimensions for the beverage cup when the larger cup can hold 16 ounces of a fluid and the smaller cup can hold 2 ounces of a fluid.

FIG. 7 depicts possible dimensions of a beverage cup of the present invention that can hold 16 ounces of fluid in the larger cup 30 and 2 ounces in the smaller cup 20. In this embodiment, the surface area of the top 40 of the smaller cup occupies from about ⅗ to about 7/10 of the surface area of the base 50 of the larger cup. The height of the smaller cup 130 can be from about 1.9 to about 2.3 inches and is preferably approximately 2.125 inches and the height of the larger cup 140 can be from about 4.1 to about 5 inches and is preferably approximately 4.67 inches. The diameter of the larger cup 90 at its widest section, which is the top opening 80 of the larger cup 30, can be from about to 3.5 to about 4.3 inches, and is preferably about 3.882 inches. The diameter of the base of the larger cup 50 measures from about 2.1 to about 2.7 inches and is preferably 2.409 inches inches, with the diameter of the top opening of the smaller cup 110 being from about 1.4 to about 1.8 inches and preferably 1.644 inches. The diameter of the base of the smaller cup 120 measures from about 1.1 to about 1.6 inches and is preferably 1.384 inches.

The diameter of the top opening of the smaller cup 110 can be from about 58% to about 78% of the diameter of the base of the larger cup 100 and preferably is 68%. The opening 40 of the smaller cup 20 can be from about 32% to about 52% of the opening 80 of the larger cup 30 and preferably is 42%. The base 70 of the smaller cup 20 can be from about 47% to about 67% of the base 50 of the larger cup 30 and is preferably 57%. The height of the smaller cup 130 can be from about 35% to about 55% of the height of the larger cup 140 and preferably is 45%.

Figure 8:
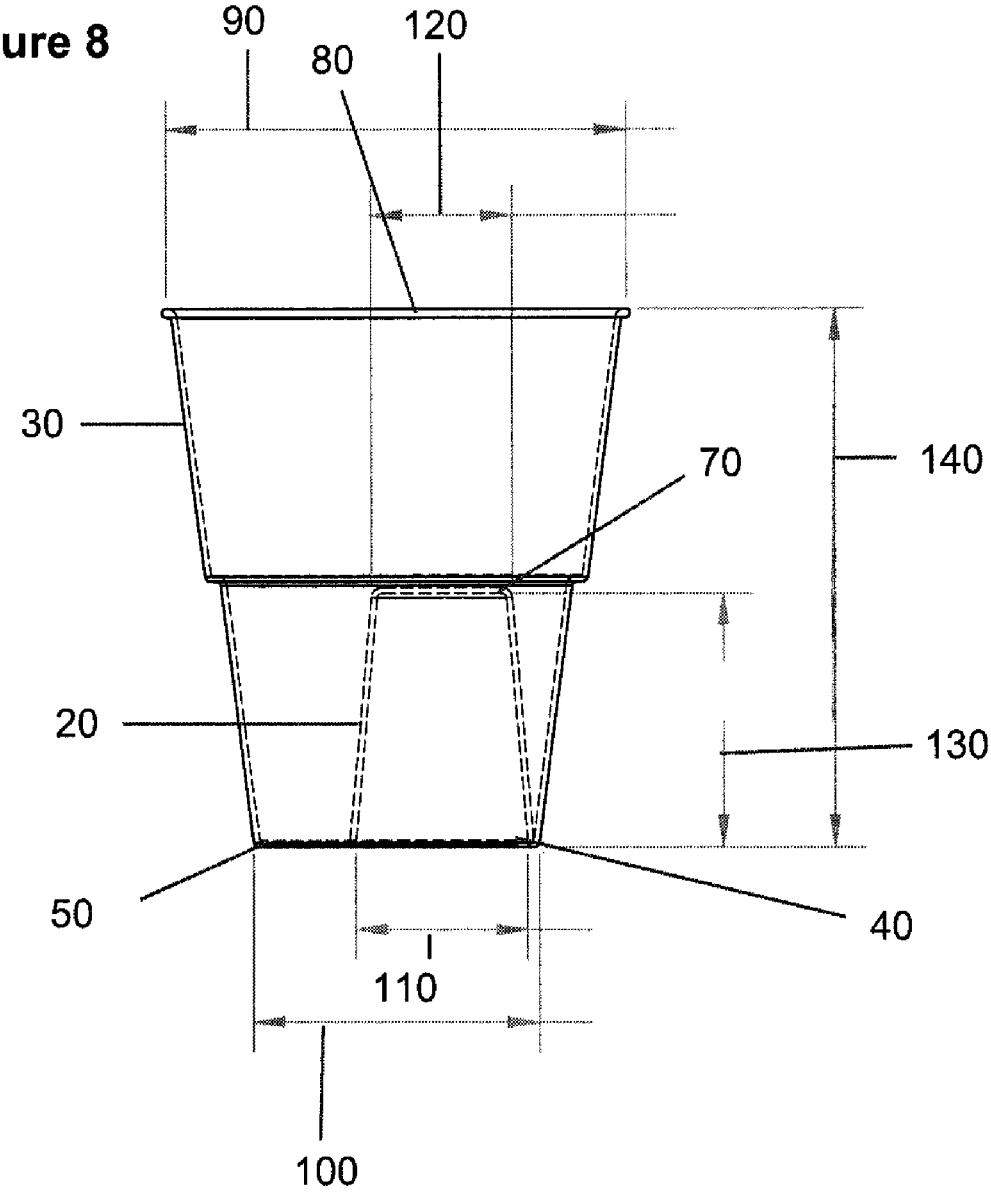
FIG. 8 shows possible dimensions for the beverage cup when the larger cup can hold 16 ounces of a fluid and the smaller cup can hold 1.5 ounces of a fluid.

FIG. 8 depicts possible dimensions of a beverage cup of the present invention that can hold 16 ounces of fluid in the larger cup and 1.5 ounces in the smaller cup. In this embodiment, the surface area of the top 40 of the smaller cup occupies from about ⅗ to about 7/10 of the surface area of the base 50 of the larger cup. The height of the smaller cup 130 can be from about 1.9 to about 2.3 inches and is preferably approximately 2.125 inches and the height of the larger cup 140 can be from about 4 to about 5 inches and is preferably approximately 4.525 inches. The diameter of the larger cup 90 at its widest section, which is the top opening of the larger cup, can be from about to 3.5 to about 4.2 inches, and is preferably about 3.882 inches. The diameter of the base of the larger cup 50 measures from about 2.2 to about 2.6 inches and is preferably about 2.409 inches, with the diameter of the top opening of the smaller cup 110 being from about 1.2 to about 1.7 inches and preferably 1.449 inches. The diameter of the base of the smaller cup 120 can measure from about 1 to about 1.3 inches and is preferably 1.189 inches.

The diameter of the top opening of the smaller cup 110 can be from about 50% to about 70% of the diameter of the base of the larger cup 100 and preferably is 60%. The opening 40 of the smaller cup 20 can be from about 27% to about 47% of the opening 80 of the larger cup 30 and preferably is 37%. The base 70 of the smaller cup 20 can be from about 39% to about 59% of the base 50 of the larger cup 30 and is preferably 49%. The height of the smaller cup 130 can be from about 37% to about 57% of the height of the larger cup 140 and preferably is 47%.

Figure 9:
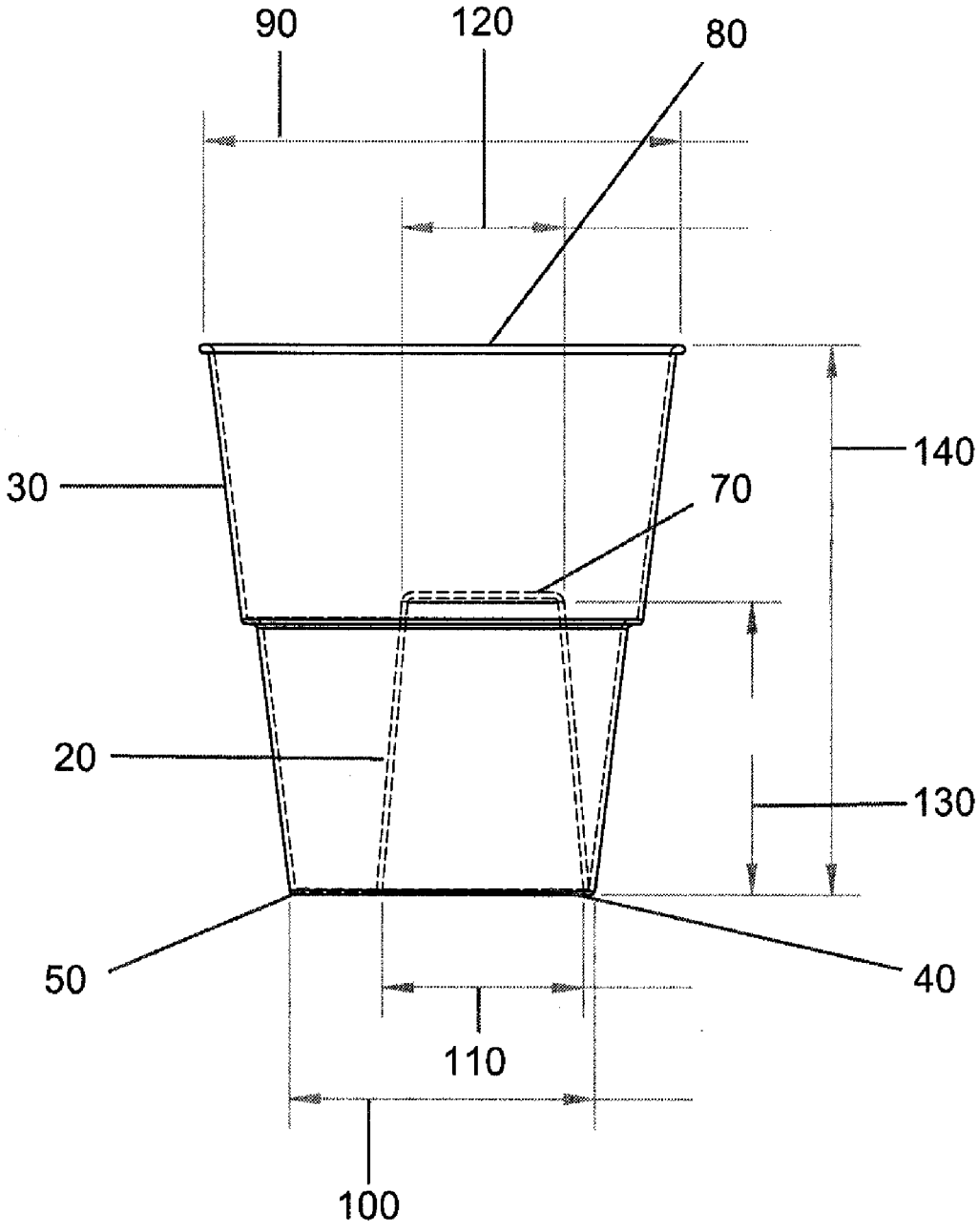
FIG. 9 shows possible dimensions for the beverage cup when the larger cup can hold 16 ounces of a fluid and the smaller cup can hold 2.5 ounces of a fluid.

FIG. 9 depicts possible dimensions of a beverage cup of the present invention that can hold 18 ounces of fluid in the larger cup and 2.5 ounces in the smaller cup. In this embodiment, the surface area of the top 40 of the smaller cup occupies from about ⅗ to about 7/10 of the surface area of the base 50 of the larger cup. The height of the smaller cup 130 can be from about 2.2 to about 2.8 inches and is preferably approximately 2.493 inches and the height of the larger cup 140 can be from about 4.1 to about 5.2 inches and is preferably approximately 4.68 inches. The diameter of the larger cup at its widest section 90, which is the top opening of the larger cup, can be from about to 3.6 to about 4.5 inches, and is preferably about 4.082 inches. The diameter of the base of the larger cup 100 measures from about 2.3 to about 2.9 inches and is preferably about 2.609 inches, with the diameter of the top opening of the smaller cup 110 being from about 1.5 to about 1.9 inches and preferably 1.716 inches. The diameter of the base of the smaller cup 120 measures from about 1.2 to about 1.5 inches and is preferably 1.386 inches.

The diameter of the top opening of the smaller cup 110 can be from about 56 to about 76% of the diameter of the base of the larger cup 100 and preferably is 66%. The opening 40 of the smaller cup 20 can be from about 25% to about 45% of the opening 80 of the larger cup 30 and preferably is 35%. The base 70 of the smaller cup 20 can be from about 43% to about 63% of the base 50 of the larger cup 30 and is preferably 53%. The height of the smaller cup 130 can be from about 43% to about 63% of the height of the larger cup 140, and preferably is 53%.

Figure 10:
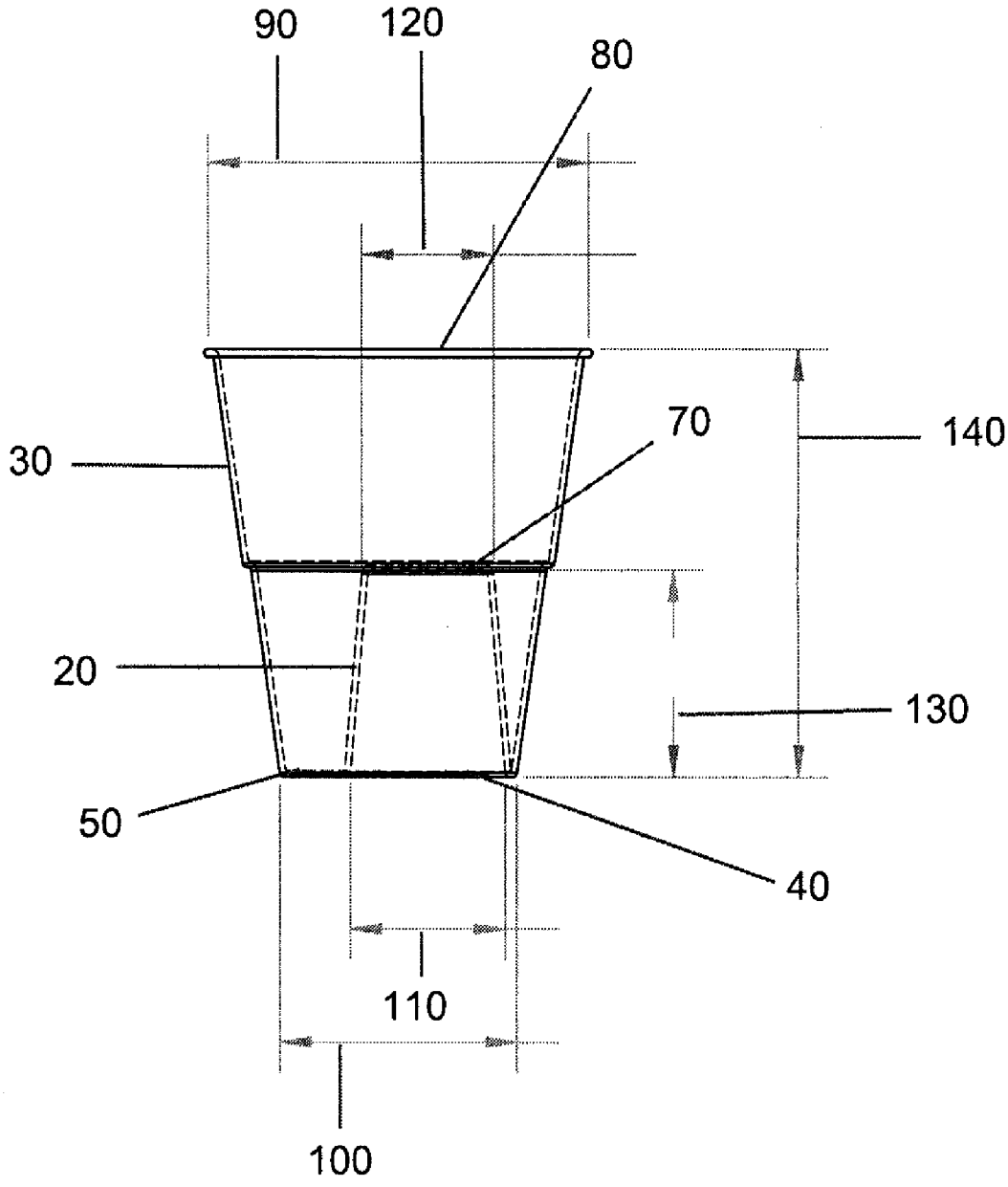
FIG. 10 shows possible dimensions for the beverage cup when the larger cup can hold 8 ounces of a fluid and the smaller cup can hold 1 ounce of a fluid.

FIG. 10 depicts possible dimensions of a beverage cup of the present invention that can hold 8 ounces of fluid in the larger cup and 1 ounce in the smaller cup. In this embodiment, the surface area of the top 40 of the smaller cup occupies from about ⅗ to about 7/10 of the surface area of the base 50 of the larger cup. The height of the smaller cup 130 can be from about 1.5 to about 1.9 inches and is preferably approximately 1.725 inches and the height of the larger cup 140 can be from about 3.2 to 4 inches and is preferably approximately 3.569 inches. The diameter of the larger cup at its widest section 90, which is the top opening of the larger cup, can be from about to 2.8 to 3.5 inches, and is preferably about 3.181 inches. The diameter of the base of the larger cup 100 measures from about 1.7 to about 2.2 inches and is preferably 1.985 inches, with the diameter of the top opening of the smaller cup 110 being from about 1.0 to about 1.4 inches and preferably 1.29 inches. The diameter of the base of the smaller cup 120 measures from about 1 to about 1.2 inches and is preferably 1.104 inches.

The diameter of the top opening of the smaller cup 110 can be from about 60 to about 70% of the diameter of the base of the larger cup 100 and preferably is 65%. The opening 40 of the smaller cup 20 can be from about 31% to about 51% of the opening 80 of the larger cup 30 and preferably is 57%. The base 70 of the smaller cup 20 can be from about 47% to about 67% of the base 50 of the larger cup 30 and is preferably 57%. The height of the small cup 130 can be from about 38% to about 58% of the height of the larger cup 140 and preferably is 48%.

Figure 11:
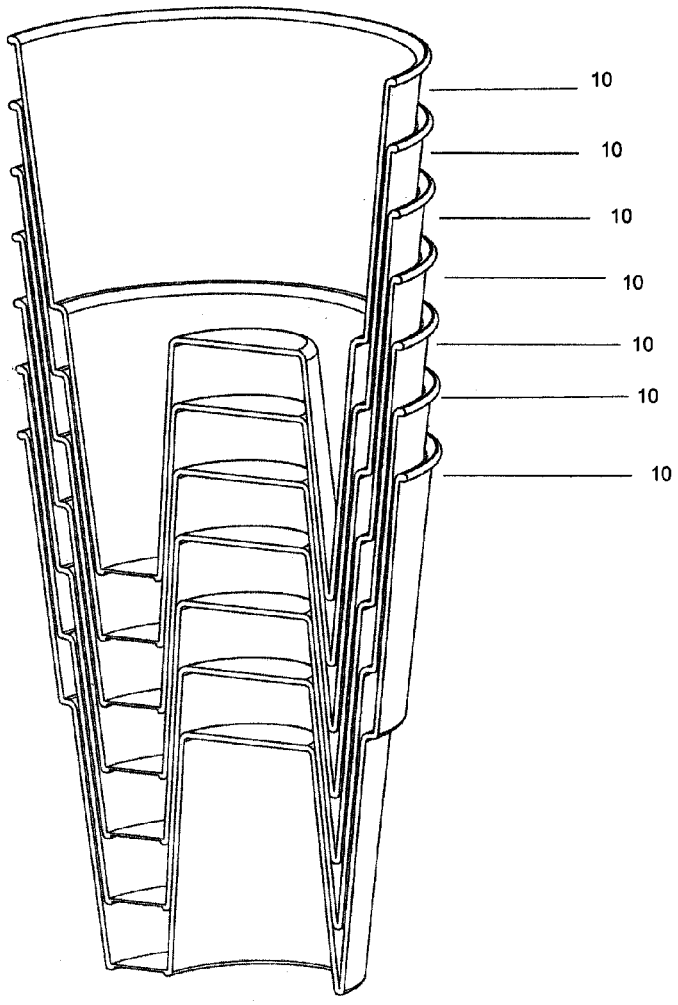
FIG. 11 shows a cross section of 7 cups stacked together.

FIG. 11 depicts a cross section of 7 individual stackable beverage cups 10 showing how the cups are stacked together.

The beverage cups of the present invention contain and can disperse a beverage out of a standard size cup e.g. 8, 10, 12, 14, 16 or 18 ounces and also dispense a beverage out of an e.g. 1, 1.5, 2, or 2.5 ounce shot cup using a smaller cup dimension than previously known in the prior art. The beverage cups are stackable in a distinctive way, wherein a first large cup is placed inside a second large cup such that the base of the large and small cups align.

The cup itself may be made of any suitable material for holding consumable beverages. In certain embodiments, the beverage cup of the present invention is disposable. In preferred embodiments, the cups are made of disposable plastic. In other embodiments the cups can be made of glass, metal, or non-disposable plastics such as polypropylene (PP); polyethylene terephthalate (PETE or PET); high density polyethylene (HDPE); low density polyethylene (LDPE); polystyrene (PS); acrylic polycarbonate; polyactic acid; and polyvinyl chloride.

We claim:

1. A reversible beverage cup comprising:

1) a large cup having a substantially circular base, an opening and a side portion, 2) a small cup having a base, a substantially circular opening and a side portion, wherein the base of the large cup meets the opening of the small cup at a common edge and wherein the base of the large cup consists of the opening of the small cup and a crescent-shaped portion which contacts a substantial portion of the opening of the small cup, and wherein the beverage cup is capable of being nested with another reversible beverage cup.

2. The beverage cup of claim 1, wherein the cup is disposable.

3. The beverage cup of claim 1, wherein the cup is made of a plastic selected from the group consisting of polypropylene, polystyrene and polyethylene terephthalate.

4. The beverage cup of claim 1, wherein the amount of beverage that can be contained in the larger cup is selected from the group consisting of 8 ounces, 10 ounces, 12 ounces, 14 ounces 16 ounces and 18 ounces.

5. The beverage cup of claim 1, wherein the amount of beverage that can be contained in the larger cup is 16 ounces.

6. The beverage cup of claim 1, wherein the base of the smaller cup is slightly offset from the center of the larger cup.

7. The beverage cup of claim 1, wherein the opening area of the smaller cup occupies approximately ¾ of the surface area of the base of the larger cup.

8. The beverage cup of claim 1, wherein the cup is made of a plastic selected from the group consisting of polypropylene; polyethylene terephthalate; high density polyethylene; low density polyethylene; polystyrene; acrylic polycarbonate; polyactic acid; and polyvinyl chloride.

9. The beverage cup of claim 1, wherein the amount of beverage that can be contained in the smaller cup is selected from the group consisting of 1 ounce, 1.5 ounces, 2 ounces, and 2.5 ounces.

10. The beverage cup of claim 5, wherein the amount of beverage that can be contained in the smaller cup is 2 ounces.

11. The beverage cup of claim 5, wherein the amount of beverage that can be contained in the smaller cup is 1.5 ounces.

12. The beverage cup of claim 1, wherein the amount of beverage that can be contained in the larger cup is 18 ounces wherein the amount of beverage that can be contained in the smaller cup is 2.5 ounces.

13. The beverage cup of claim 1, wherein the amount of beverage that can be contained in the larger cup is 8 ounces wherein the amount of beverage that can be contained in the smaller cup is 1 ounce.

14. The beverage cup of claim 1, wherein the common edge of the base of the larger cup and the opening of the smaller cup is approximately ⅜ of 1 inch long.

15. The beverage cup of claim 1, wherein the surface area of the top of the smaller cup occupies from about ⅗ to about 7/10 of the surface area of the base of the larger cup.

* * * * *